US005551104A

United States Patent [19]

Hartline

[11] Patent Number: 5,551,104

[45] Date of Patent: Sep. 3, 1996

[54] COLLAPSIBLE SOFA BED MATTRESS

[75] Inventor: Michael F. Hartline, Tupelo, Miss.

[73] Assignee: Super Sagless Corporation, Tupelo, Mich.

[21] Appl. No.: 412,610

[22] Filed: Mar. 29, 1995

Related U.S. Application Data

[63] Continuation of Ser. No. 118,972, Sep. 9, 1993, abandoned.

[51] Int. Cl.[6] ..... A47C 17/04

[52] U.S. Cl. ..... 5/13; 5/249; 5/719; 5/722

[58] Field of Search ..... 5/13, 240, 249, 5/250, 464, 475, 476, 477

[56] References Cited

U.S. PATENT DOCUMENTS

| | | | |
|---|---|---|---|
| 4,377,279 | 3/1983 | Schulz | 5/250 |
| 4,442,556 | 4/1984 | Craigie | 5/465 |
| 5,257,424 | 11/1993 | Rogers | 5/13 |

*Primary Examiner*—Flemming Saether
*Attorney, Agent, or Firm*—Wolf, Greenfield & Sacks, P.C.

[57] ABSTRACT

A mattress of a sofa bed contains a portion which is collapsible and portions which are conventional and non-collapsible. The collapsible and non-collapsible portions are hinged to fold within a sofa bed frame.

9 Claims, 5 Drawing Sheets

COLLAPSIBLE SOFA BED MATTRESS

This application is a continuation, of application Ser. No. 08/118,972, filed Sep. 9, 1993 now abandoned.

This invention relates to mattresses for sofa beds and the like and, more particularly, to a mattress which can partially collapse in order to facilitate its folding and storage within a sofa bed frame or other limited space.

Sofa beds sold presently generally employ a separate mattress which is almost certainly foldable and in some instances compressible within a folded sofa bed frame. As the industry has moved away from the older thin mattresses to thicker mattresses to more closely approximate the size and comfort characteristics of fixed bed mattresses, a problem which has been compounded is the ability to fold and compress the thicker mattress within a sofa bed frame adequately so that the seating position does not become too uncomfortably high. An additional problem with compressing conventional box spring or foam rubber mattresses has been that if the mattress is compressed excessively, upon opening of the sofa bed frame, the compressed mattress tends to force the bed frame to "spring out" of the sofa bed frame, thereby potentially causing injury to the user. One solution to prevent this type of injury is to provide a lock to prevent such springing action. Such a mechanism is disclosed in U.S. Pat. No. 4,918,770 issued to Hartline et al. and assigned to the assignee of the present invention.

However, even with an effective mechanism such as disclosed in Hartline et al. to adequately compress the mattress and prevent the mattress from springing out of the bed frame, efforts have been made to reduce the overall thickness of the mattress substantially to allow the use of mattresses in even very shallow sofa beds. As can be seen in U.S. Pat. Nos. 4,620,336, U.S. Pat. No. 4,654,905 and U.S. Pat. No. 4,489,450, all to Miller, each of these patents discloses a mattress which is fully collapsible and which may be foldable in the collapsed configuration. As disclosed in the foregoing Miller patents, the mattress consists of two parallel planar surfaces interconnected by folding or pivoting support means. When folded, the pivoting support means will move to bring in close proximity the two planar surfaces of the mattress which form the top and the bottom of the mattress surface. The support means may be comprised of a number of springs having a generally sinuousidal or wavy shape. The springs provide both support to separate the upper and lower planar portions of the mattress as well as providing a resilient surface for the mattress. In each of the foregoing Miller patents, the folding mattress contains pivoting springs throughout the totality of the mattress structure.

While the ability to fold the mattress may achieve the effect of substantially reducing the amount of space a mattress takes within a sofa bed structure, the mattress in its upright expanded position tends to be less comfortable than conventional bed mattresses. This is due in part to the form and the structure of the springs within the collapsing mattress which are a compromise between the desire to provide support to the upper part of the mattress while providing sufficient comfort to the user. Usually, a foam rubber or other suitable pad is placed over the folding springs but this may still not achieve the same comfort level as a conventional coil spring or foam mattress.

If the mattress could be made so that only portions of the mattress are completely collapsible while other portions of the mattress remain of conventional coil spring construction, then a better compromise is achieved, in that the mattress would provide support in a conventional manner for those portions of a user's body which most require such support while maintaining substantially or nearly the same collapsibility as a mattress which is comprised wholly of collapsible elements. Accordingly, the principal object of the present invention is to provide a mattress which may be incorporated into a sofa bed frame and which comprises portions which are collapsible and portions which are of substantially conventional coil spring or foam rubber construction. Another objection of the present invention is to provide a means incorporated into the sofa bed frame which will cause the collapsible portion of the mattress to automatically collapse when the bed frame is moved from the extended use position into a folded storage position.

Yet another object of the present invention is to provide a partially collapsible mattress wherein a portion of the mattress which is not collapsible provides substantial support to seat cushions positioned over the mattress when in the folded position within a sofa bed. When the sofa bed frame is moved from the folded storage position to its open, support position, linkages will automatically cause the collapsed portion of the mattress to become erected into its use and supporting position.

These and other objects and features of the present invention will be better understood and appreciated from the following detailed description of the embodiments thereof read in connection with the accompanying drawings.

DETAILED DESCRIPTION OF THE DRAWINGS

Figure 1:
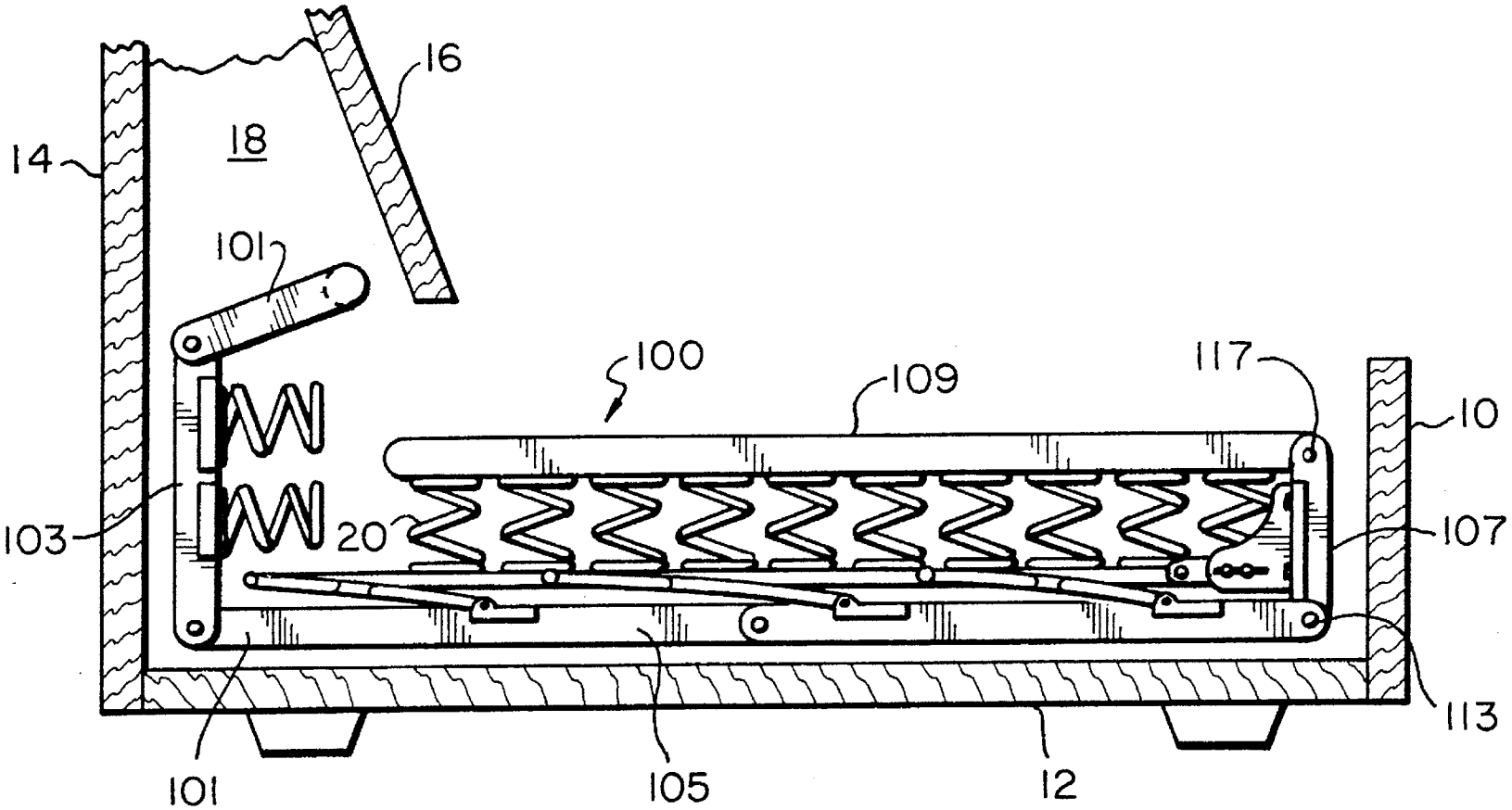
FIG. 1 is a side elevation view of a sofa bed in accordance with the invention in which the mattress is in the folded or storage position within the sofa bed.

The sofa bed shown in FIG. 1 includes a front rail 10, a bottom support frame 12, which supports the sofa as well as the mattress within the sofa bed, a back upright support 14 and a back support 16 formed within the frame. The upright support 14 and the back support 16 form between them as shown in FIG. 1, a space 18 which receives, as shown in FIG. 1, a portion of a folded up mattress 20. In conventional manner, the mattress 20 folded as in FIG. 1 would have placed thereon pillows or other cushions to form a seating portion of the sofa bed. As well, in conventional use, back pillows may be placed against the back support 16 for users' comfort.

Figure 2:
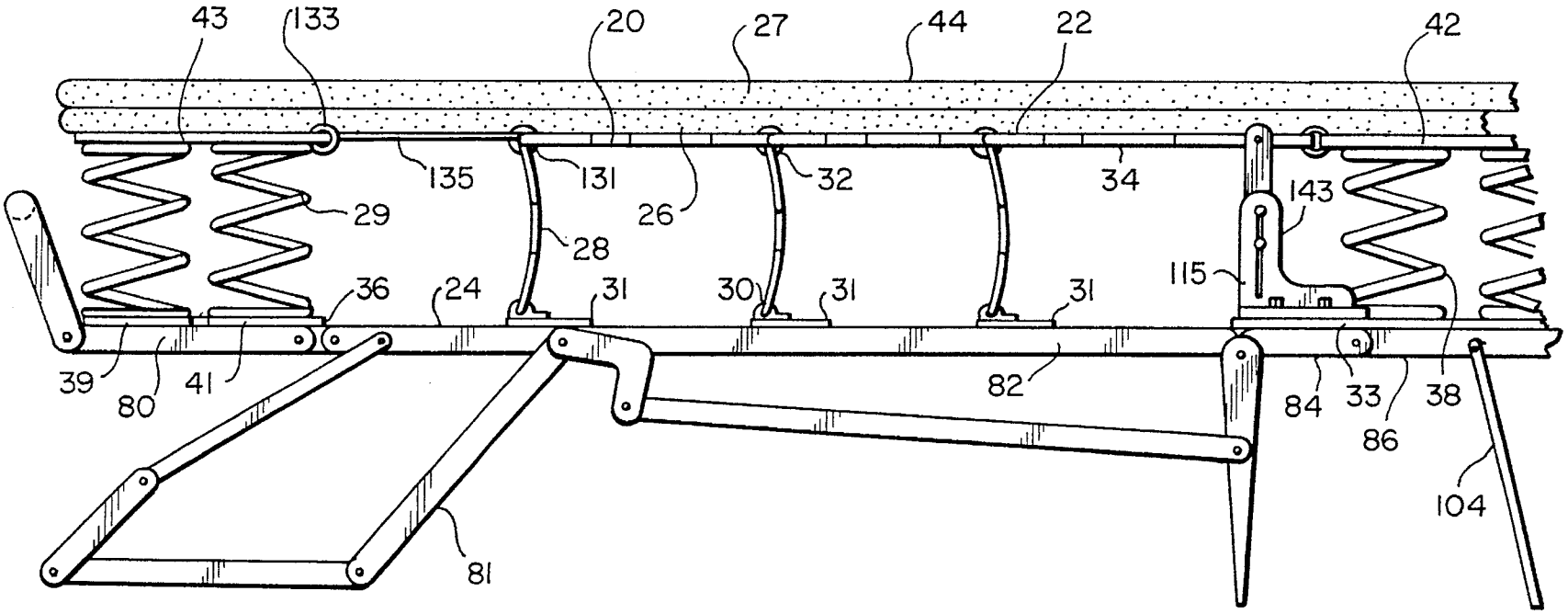
FIG. 2 is a side elevation view of a sofa bed of the present invention with the bed frame in a fully open configuration.
Figure 6:
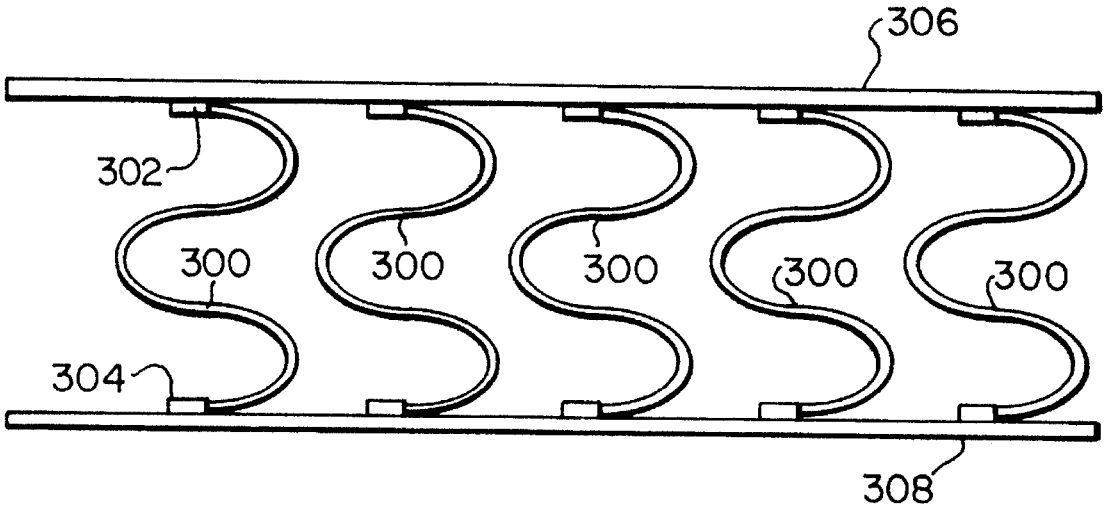
FIG. 6 is a side view of a transverse row of sinuous springs.

Referring now to FIG. 2, that figure shows a construction of a collapsible mattress portion 20 made in accordance with the present invention. The collapsible mattress portion 20, shown in its extended or use position in FIG. 2, is comprised of two planar surfaces, an upper planar surface 22 and a lower planar surface 24. Lower planar surface 24 may be constructed preferably of relatively non-resilient materials such as wood, plywood, fiberboard, metal or other suitable materials, as explained in detail below. The upper planar surface 22 is preferably constructed of a more resilient material. Surface 22 will form the surface most closely in contact with the user. Accordingly, in order to provide adequate comfort to the user of the mattress, a first pad 26 is placed overlying the upper planar surface 22. The pad 26 may be of any desired thickness but preferably of one-half inch thickness of a type material which is known in the trade as a shoddy pad. In order to increase comfort, preferably a second pad 27, which may be of one inch or any desired thickness, is placed over the shoddy pad 26 and may be formed of any suitable material such as high density foam. As seen in FIG. 2, the collapsible mattress as shown in its open or support position, the two surfaces 22 and 24 are spaced from one another in a position to support upper surface 22 by a series of springs 28. Springs 28 may be conventional curved sinuous wire springs and are supported by a number of hinge clips 30 and 32 (to be described in detail below) which are formed on opposing facing inside surfaces 34 and 36, respectively, of surfaces 22 and 24. Of course, other types of springs may be utilized such as springs with a generally U-shaped cross section or foldable coil springs. The two surfaces 22 and 24 move from the upright or support position of FIG. 1 to the folded position of FIG. 2 by pivoting of the springs 28 within the hinge clips 32 and 30. As seen in FIG. 2, the hinge clips 32 will serve as pivot points for the springs 28. The mattress moves from its collapsed to its upright or erect position by pivoting of the springs 28 on the hinge clips 32 and 30 respectively by movement of the top surface 22 in a direction away from the back surface 16 of the sofa bed. As shown in FIGS. 1 and 2, the two surfaces will not move away from one another in a purely parallel fashion, but rather by a pivoting action, such that, when folded, the upper surface 22 will have moved both down towards surface 24 as well as displaced by the pivotal movement on hinge clips 30 and 32 which causes the two surfaces 22 and 24 to approach each other. FIG. 6 illustrates a view of the embodiment of FIG. 1 taken from an end position along line 6—6 of FIG. 2, such that the sinuous spring 200 is supported by upper 202 and lower 204 hinge clips on, respectively, upper planar surface 206 and lower planar surface 208. It is to be understood by those skilled in the art that while one sinuous spring 200 is shown, a number of such springs are contained in the collapsible portion of the mattress as shown by the plurality of springs 28 in FIG. 1.

Earlier, it was mentioned that the lower support surface 24 may be constructed of or has a material which is more or less non-resilient. While this surface could be a unified platform such as a plywood or metal board, it is preferred that the surface be constructed of a number of wooden or other material boards 31 shown, placed endwise in FIG. 1, due to the board's better resiliency. The boards 31 have attached to them hinge clips 30 which hinge springs 28. The boards may be of any suitable thickness and width to adequately support springs 28 and 29 and may be ¾"×3½" in thickness and width.

Figure 3:
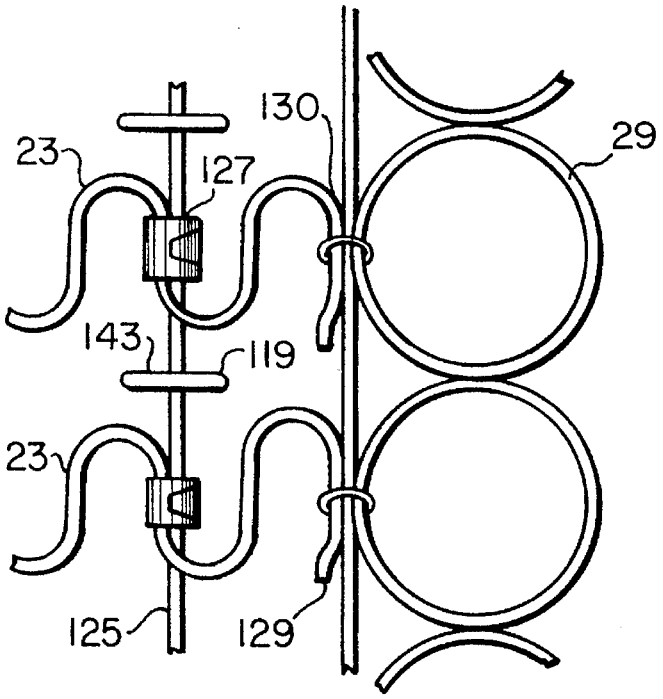
FIG. 3 is a partial top view of the arrangement of the support springs along line 3—3 in FIG. 1.

The upper surface 22 of the mattress may be formed of different material which provides support yet give at least some resiliency to the surface. As shown in FIG. 3, the surface 22 may be composed of sinuous springs 23 interlinked to form a resilient surface which in turn is covered by parts 26 and 27.

As shown in FIG. 2, the entire mattress surface of the present invention is not made up of the collapsible sinuous wire springs but only a portion thereof. In addition to the collapsible portion 20, there are two relatively non-collapsible portions of the mattress 38 and 39, which are contiguous to collapsible portion 20. The relatively non-collapsible portions 38 and 39 are comprised of lower surfaces 40 and 41 and upper surfaces 42 and 43, respectively. The upper surfaces and the lower surfaces are separated by a distance approximately equal to the distance between the upper surface 22 and the lower surface 24 of the collapsible mattress portion when the mattress 20 is in its open and sleep position of FIG. 2. A series of coil springs 29, shown also in FIG. 3, support and separate the non-collapsible surfaces. Of course, the use of coil springs, such as Bonnell coils, is for the purposes of illustration only, as other types of springs or even foam rubber may be utilized. The coil springs 29 in the non-collapsible portions may be supported by boards 46 similar to the boards 31 used to support sinuous springs 28. As is evident from FIG. 1, the mattress combination of collapsible and non-collapsible portions positions a non-collapsible portion in the head area and lower body areas of the mattress, with support for a person's upper torso being given by the collapsible portion of the mattress. Of course, the collapsible and non-collapsible portions may be moved or interchanged as desired. On the bottom-most side 40 of the relatively non-collapsible portion, a suitable cushioning material such as foam, preferably of a thickness in the range of one to three inches, is placed as shown in FIG. 1 of the mattress portion 38. This bottom-most surface 40 will become the topmost surface when the mattress is folded, as seen in FIG. 1. The pad and the high density foam portion which covers the collapsible portion 20 is continued over to and includes the surface of the mattress portions 38 and 39. Therefore, in the mattress position shown in FIG. 1, the combination of the collapsible portions of the mattress 20 and the relatively non-collapsible portion of the mattress 38 will form an upper support surface 44 which is uniform and planar over the entire surface of the mattress.

Referring now to FIG. 2, which shows the mattress in an open support position, a support frame for the mattress is generally noted as frame 81 and may be made in a conventional manner, such as that disclosed in Hartline U.S. Pat. No. 4,918,770. The frame 81 is generally comprised of a series of horizontal support frame members. As shown in FIG. 1, the bottom portion 24 of the mattress is divided by boards 31 into segments of separable material, a first segment 80, a second segment 82, a third segment 84 and a fourth segment 86. The segments 80, 82, 84 and 86 comprise separate portions of the planar bottom 24. Separation, for example, between planar portion 80 and portion 82 may simply be a break in the materials forming those two portions or there may be a hinge or other flexible connection between portions 80 and 82. Portions 82 and 84 and portions 84 and 86 may be similarly constructed. The purpose of providing separable portions 80, 82, 84 and 86 is to allow the mattress to be folded within a sofa bed frame to a position shown in FIG. 2. As shown in FIG. 2, the separations of the portions 80, 82, 84 and 86 allow the mattress to assume the folded position shown in FIG. 1 Ito be described below. The mattress of the present invention which is foldable in the sofa bed shown in FIG. 1 must have a frame to support the mattress when the mattress is in its open or sleep support position. FIGS. 1 and 2 show generally a frame 100 which serves to support the entirety of the mattress in the support position. The frame 100 has articulated sections 101, 103, 105, 107 and 109 which coincide with the separations in sections 80 (101 and 103), 82(105), 84(107) and 86(109) of the mattress. Sections 101, 103, 105, 107 and 109 are generally constructed of metal tubes or angle iron in the conventional manner to support conventional sofa bed mattresses. Section 101 is commonly referred to as the head tube and forms the upper portion of the frame 100. It is joined in a rigid manner to section 103. Section 103 has attached to it the front non-collapsible portion 39. In the portion of FIG. 1, section 103 and its corresponding mattress portion 41 are folded into space 18. A pivot joint 111 joins section 103 to the next section 105. This pivot joint 111, which may be made by any of a number of conventional hinges or resilient materials, allows the sections 103 and 105 to move from their generally perpendicular relationship of FIG. 1 to an in-line position of FIG. 2.

Section 105 is shown in FIG. 1 as supporting the collapsible portion of the mattress and boards 31 may be suitably mounted onto section 105. A second pivot joint 113 joins section 105 to section 107. Section 107 has mounted upon it a glide plate attachment 115, the purpose and operation of which will be explained below. A third pivot joint 117 joins section 107 to section 109, conventionally referred to as the front tube which has attached to it the second non-collapsible portion of the mattress. As can be seen with reference to FIGS. 1 and 2, section 109 provides support for the second non-collapsible portion of the mattress 38.

It is desirable to have a means for causing the collapsible portion of the mattress to assume its open or sleep position when the bed frame containing the mattress is pulled out of the sofa bed frame for use. To that end, the present invention contemplates a series of articulated links or other means which will cause the mattress, upon its unfolding from the sofa bed frame, to erect that portion of the mattress which is collapsible. As shown in FIG. 1, the mattress is in its folded or storage position, and the collapsible portion of the mattress is in its collapsed position. The non-collapsible portion of the mattress 38 overlies a portion of the collapsed mattress 20. In order to move the bed frame from its folded position to its use position of FIG. 2, the user will pull the bed frame up and over the front rail 10 in the conventional manner. When the bed frame is unfolded from the position of FIG. 1 to the position of FIG. 2 in the conventional manner, front legs 104.will descend into the position as shown in FIG. 2 to support the foot section portion of the mattress 38. In the position of FIG. 1, section 107 is in an upright, vertical position and in FIG. 2 is in a horizontal position.

Figure 4:
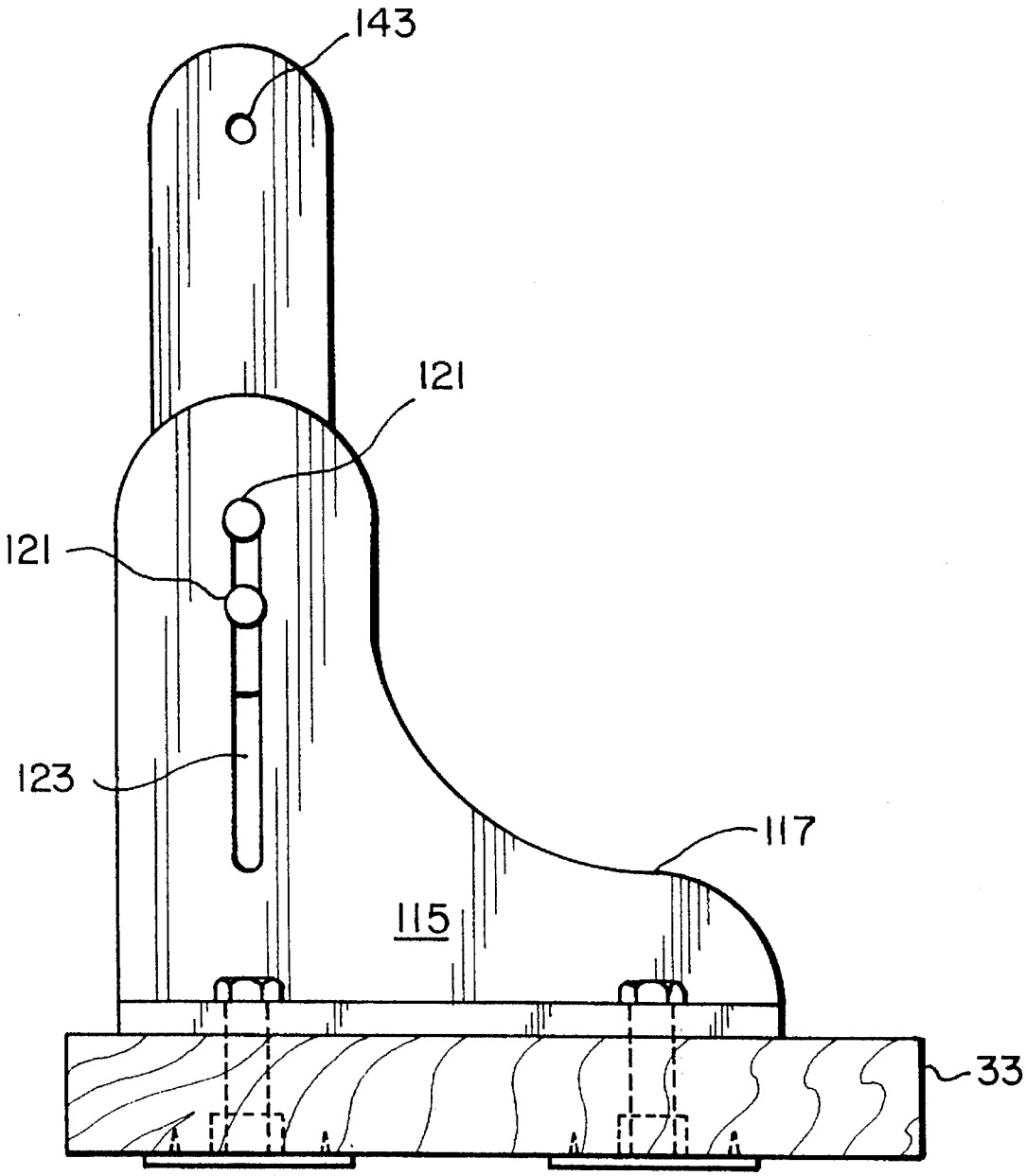
FIG. 4 is a detailed side view of a glide plate attachment shown in FIG. 2.
Figure 5C:
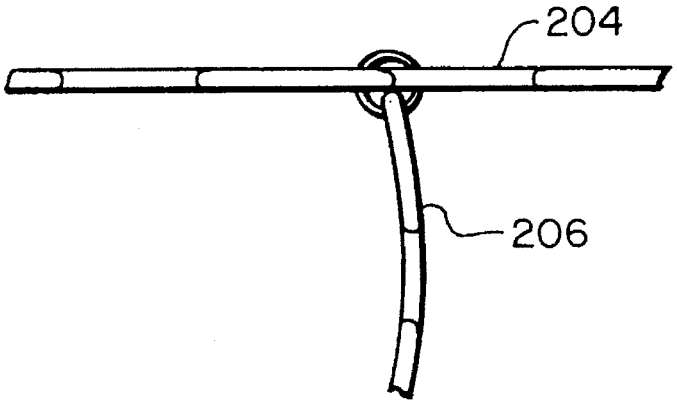
FIGS. 5(*a*) through 5(*d*) illustrate the use of a hinge clips to join various spring members in the mattress of the present invention.
Figure 5D:
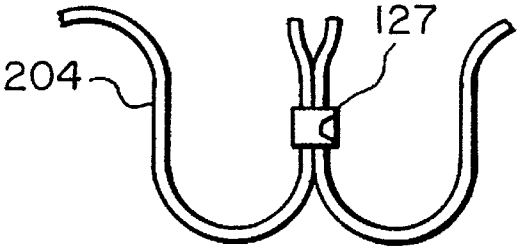
Figure 5A:
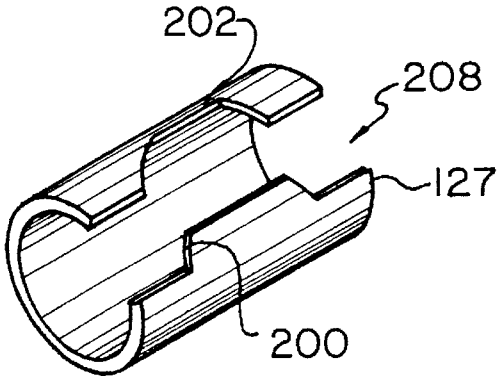
Figure 5B:
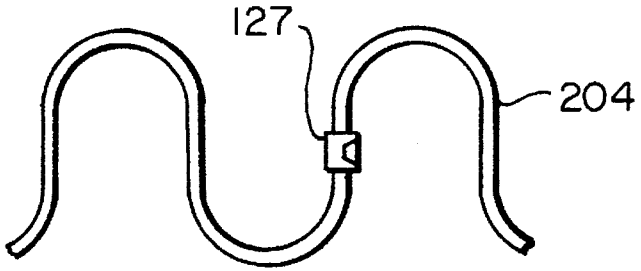

Glide plate attachment 115 is shown in detail in FIG. 4. The attachment 115 is comprised of a section 117 which is fixed to support 33 by screws or bolts to be rigidly fixed thereto. Support 33 may be a board, like boards 31 which support springs 28 and 29, suitably dimensioned to securely seat attachment 115. Support 33 is secured to section 107 in any of a number of conventional mechanisms. A movable section 119 is joined to section 117 through one or more rivets or pins 121 riding in a slot 123. The position of the section 119 in slot 123 in FIG. 4 corresponds to its position in FIG. 2 in which the mattress is in its open or sleep position. When the mattress is folded within the: sofa bed, section 119 moves from its position shown in FIG. 4 to that shown in FIG. 1 in which the pins 121 move (with section 119) to a position in the direction of board 33, then decreasing extension of section 119. Section 119 also has an aperture 143 formed on its outer end, the purpose of which will now be explained with reference to FIGS. 1, 2 and 3.

When the mattress and support frame is moved from the stored position of FIG. 1 to the open or sleep position of FIG. 2, some mechanism must be provided to raise the collapsible portion from a collapsed to an upright non-collapsed position and retain it in that position so that it may be used by and support the weight of one or more persons.

As seen in FIG. 3, a rod like member 125 passes through the aperture 143 in section 119. It is to be understood that there are at least a pair of sections 115 attached to board 33 in order to support the collapsible mattress across the entire surface 22. Thus, member 125 will pass through the respective apertures 143 of attachment 115. As shown in FIG. 3, the member 125 will have joined to it a portion of the sinuous springs 23 by a plurality of suitable members or hinge clips 127. Members 127 join the springs 23 to the member 125 but allow for movement of each with respect to the other.

The hinge clips 127, shown in detail in FIG. 5(*a*) is of metal construction of a generally tubular shape. Tooth 200 and indent 201 are dimensioned to be complimentary in size and shape to mate with each other. The clip is installed on the springs with a pneumatic or other suitable device which closes the gap 208. The clip is dimensioned, when in the closed position over the springs 204 shown in FIGS. 5(*b*)–5(*d*) to secure the springs 204 but to allow for relative movement of springs with respect to one another. The clips may be lined with paper or other suitable matieral to lessen metal-to-metal noise during movement of springs 204 when joined by hinge clips 127.

In FIGS. 5(*b*) and 5(*c*), top and side views respectively, the hinge clip 127 is shown as joining the upright sinuous wire springs 206 (corresponding to springs 28 in FIG. 2) to the sinuous wire springs 204 forming the upper surface of the collapsible mattress of FIGS. 1 and 2. FIG. 5(*d*) illustrates the positioning of the hinge clip 127 at joint locations for sinuous wire springs 204. Thus, it can be appreciated that the spring clip 127 is a versatile device which can be used to join various members of the collapsible portion of the mattress shown in FIGS. 1 and 2. In addition, in FIG. 3 the end portions 129 of the sinuous springs 23 are joined to top portion 42 by hinges or other members (such as hog rings 130 well known in the art) which allow for movement.

On the opposite end of the collapsible spring portion 22 (towards the head portion of the mattress) as seen in FIG. 2, the edge portion 131 of the spring portion 22 and the edge portion 133 of the head portion 41 are joined by a series of multistrand wires 135 through flexible connectors, or hinges or hog rings. Instead of the wires 135, strong but flexible material or wire cloth may be substituted as desired.

The combination of the wire 135 and the rod-like members act to "pull" the collapsed mattress to an upright position when the assembly is moved from the storage to the use or sleep position. The attachment 115 serves to draw the collapsible section up to an upright position while the ability of the section 119 to move in a vertical up and down movement allows for resiliency of the mattress at the point where the rod-like member is joined to section 119. When the mattress is folded in the storage position of FIG. 2, the section 119 will move or retract towards the base of section 117, as shown in FIG. 2 with rivets or pins 121 moved towards the base of section 115.

The operation of the mattress support of the present invention will now be described with reference to FIGS. 1 and 2. With reference to FIG. 1, FIG. 1 shows the sofa bed with the mattress in its storage position and with the upper pillows or other cushions removed from the upper surface of the mattress. The collapsible portion of the mattress 20 is in its collapsed position with a portion of the collapsed position being within the space 18. Upon moving the bed frame out of the sofa bed frame and to the position of FIG. 1, the relatively non-collapsible portion 38 is lifted and swung clockwise about the pivot 117 shown in FIG. 2. As the mattress portion 38 is pivoted the portion 107 will move from its vertical position of FIG. 2 to its horizontal position of FIG. 1. While moving to its horizontal position as shown in FIG. 1, the attachment 115will pull the rod-like member 125 and sinuous springs forming the upper surface 22 with hinge clips 127) within the collapsible portion of the mattress, thus raising the mattress from its collapsed to the erect or upright position as shown in FIG. 1.

As seen in FIG. 2, the multistrand wire 135 will maintain the mattress in a position such that the upper surface will maintain its erect position. If desired, suitable locking means may be provided to provide an over-the-center lock to assure that the collapsible mattress will stay erect.

After use or at any time when it is desired to fold the mattress back into the sofa bed frame, the portion 38 is first folded over in a counterclockwise direction around pivot 117. This not only causes the front leg 104 to retract but also causes the portion 107 to return to the vertical position. This action causes the multistrand wire 135 to cause the springs 28 within the collapsible portion of the mattress to fold back to the position as shown in FIG. 1. Subsequently, the bed frame is moved to within the sofa bed frame.

As shown in the preferred embodiment, the collapsible portion is shown as the portion which would correspond to that portion of the mattress in which a person's head and upper torso would be located. The relatively non-collapsible portion corresponds to that portion of the mattress where a user's lower portion of the body would be located. It is, of course, possible to vary the position of the collapsible and relatively non-collapsible portions of the mattress so that, for example, the head and upper torso portion of a person's body would be supported by the relatively uncompressible and non-collapsible portion 38 and the remaining part of the body would be supported by a collapsible section of the bed. The collapsible and non-collapsible portions could also be arranged in an alternative fashion, for example, collapsible head and foot portions, with a non-collapsible middle portion.

The present design also has the advantage that, due to the collapsibility of the portions of the mattress, a 10 inch thick firm mattress may be incorporated in a sofa bed in standard sofa bed frames currently available. This compares with a maximum 7 inch thick conventional mattress which may be fitted in current sofa bed frames. However, because the foot portion will form the upper exposed surface of the mattress when it is in the folded position, and thus cushion the seating position, it may be desirable to construct the foot portion to be non-collapsible.

Having described this invention in detail, those skilled in the art will appreciate that many modifications may be made of this invention without departing from its spirit. Therefore, it is not intended that the breadth of this invention be limited to the specific embodiment illustrated and described. Rather, it is intended that the scope of this invention be determined by the appended claims and their equivalents.

What is claimed is:

1. A sofa bed comprising:

a sofa frame having a back, seating area and front rail with the seating area including a cavity for the storage of the bed frame and mattress when the sofa bed is in the sofa configuration, a folding bed frame secured to the sofa frame and having a head section that extends upwardly behind the back of the sofa bed when in the sofa configuration, a main section connected to the head section and spanning the front rail when in the bed configuration and lying within the cavity in the sofa configuration, an intermediate section pivotally connected to the main section and a foot section pivotally connected to the intermediate section, said head, main, intermediate and foot sections being coplanar when the bed frame is in the bed configuration and said intermediate section lying perpendicular to the main section and the foot section lying parallel to and spaced above the main section when the bed frame is in the sofa configuration, and a mattress disposed on the bed frame and having a protion which is non-collapsing and a collapsible portion which is not collapsed when the frame is in the bed configuration and which is collapse when the frame is in the sofa configuration, wherein the portion which is non-collapsing is a foot portion overlying the foot section and the portion which is collapsible is a portion overlying at least one of the head, main or intermediate sections of the bed frame.

2. A sofa bed as defined in claim 1 wherein the head, main or intermediate collapsible portions of the mattress each have separate rigid lower panels and springs pivotally mounted on the lower panels and lying generally parallel to the lower panels when the mattress portions are collapsed and standing generally perpendicular to the panels when the bed frame is in the bed configuration.

3. A sofa bed as defined in claim 2 wherein the foot portion of the mattress comprises coil springs.

4. A sofa bed as defined in claim 2 wherein the head portion of the mattress is non-collapsible and comprises coil springs.

5. A sofa bed as defined in claim 2 wherein the springs in the head, main and intermediate portions of the mattress are sinuous in shape and lie in transverse rows across the mattress.

6. A sofa bed as defined in claim 2 wherein additional rows of sinuous wires extend longitudinally of the mattress and connect the transverse rows of springs, said additional rows forming an upper mattress platform and being disposed in a horizontal plane when the mattress is in the bed configuration.

7. A sofa bed as defined in claim 1, the bed frame including means associated with the mattress to move the mattress from its collapsed to its non-collapsed position when the bed frame is moved from the sofa configuration to the bed configuration.

8. A sofa bed as defined in claim 7, wherein the means associated with the mattress comprises at least one link linking the mattress and the bed frame.

9. A sofa bed as defined in claim 8, wherein at the least one link is attached to the intermediate section, and whereby pivotal movement of the intermediate section towards the bed configuration causes the link to move the mattress from its collapsed to its non-collapsed position.

* * * * *